United States Patent [19]

Balfour

[11] 4,204,564

[45] May 27, 1980

[54] GASOLINE SPILL PREVENTING APPARATUS

[76] Inventor: Lawrence H. Balfour, 252 S. Grant Ave., Indianapolis, Ind. 46201

[21] Appl. No.: 912,528

[22] Filed: Jun. 5, 1978

[51] Int. Cl.[2] ..... B65B 3/04

[52] U.S. Cl. ..... 141/311 A; 137/572; 141/51; 141/122; 222/110

[58] Field of Search ..... 141/51, 392, 115, 121, 141/122, 311 A, 311 R; 222/108, 109, 110; 137/571, 572, 575

[56] References Cited

U.S. PATENT DOCUMENTS

| | | | |
|---|---|---|---|
| 1,732,505 | 10/1929 | Dawson | 137/576 |
| 3,129,747 | 4/1964 | Warner | 137/571 |
| 3,207,203 | 9/1965 | Mack | 137/576 |
| 3,520,329 | 7/1970 | Weber | 137/571 |
| 3,610,220 | 10/1971 | Yamada et al. | 137/571 |
| 3,967,660 | 7/1976 | Russell | 141/392 |

*Primary Examiner*—Steven L. Stephan

*Attorney, Agent, or Firm*—Woodard, Weikart, Emhardt & Naughton

[57] ABSTRACT

Disclosed is an assembly including a dump tank disposed near the fill pipe for an underground gasoline storage tank at an automobile service station. The tank is normally isolated by a hand valve and a check valve from communication with the storage tank fill pipe, however, when the storage tank has been filled from a transport vehicle, the gasoline in the fill pipe and the flexible delivery hose may be dumped into the dump tank by opening a manually operated valve. The check valve permits gasoline thus dumped to flow from the dump tank back to the storage tank as gasoline is pumped from the storage tank during normal pump operation of the service station.

7 Claims, 3 Drawing Figures

GASOLINE SPILL PREVENTING APPARATUS

BACKGROUND OF THE INVENTION

Various overflow tanks and auxiliary holding tank systems are well known in the prior art and examples of these are disclosed in the U.S. Pat. Nos. 3,610,220; 3,520,329; 3,207,203; 3,129,747 and 1,732,505. However, none disclose a system adaptable to the problem of gasoline spillage or overflow at the fill situs of underground storage tanks at typical automobile service stations. Present filling methods involve parking a transport vehicle adjacent the fill pipe of an underground storage tank, attaching the transport vehicle's flexible hose (connected to the transport tank through a valve at a control panel on the transport vehicle) to a fitting at the accessible, ground level, upper end of the underground storage tank fill pipe. The vehicle mounted valve is then opened and the storage tank is filled. When the storage tank has been filled, the valve is closed and the hose is disconnected from the fill pipe. The gasoline filling the hose spills and runs off into the area around the fill pipe. Further, since the fill pipe is full, there is spillage at the fill pipe as the hose is disconnected and the fill pipe cap is reinstalled. Deliveries to such storage tanks are made weekly, or more often if necessary, and the accumulation of spilled gasoline disperses through the sand conventionally used as a backfull for buried storage tanks. The accumulated spillage may then be carried away by subsurface water movement to contaminate sewers and basements and is an obvious hazard.

The apparatus of the present invention provides a means for retaining the gasoline filling the delivery hose by directing it to a dump tank which is automatically drained into the storage tank as gasoline is pumped therefrom in normal service station operation.

DESCRIPTION OF THE PREFERRED EMBODIMENT

Figure 1:
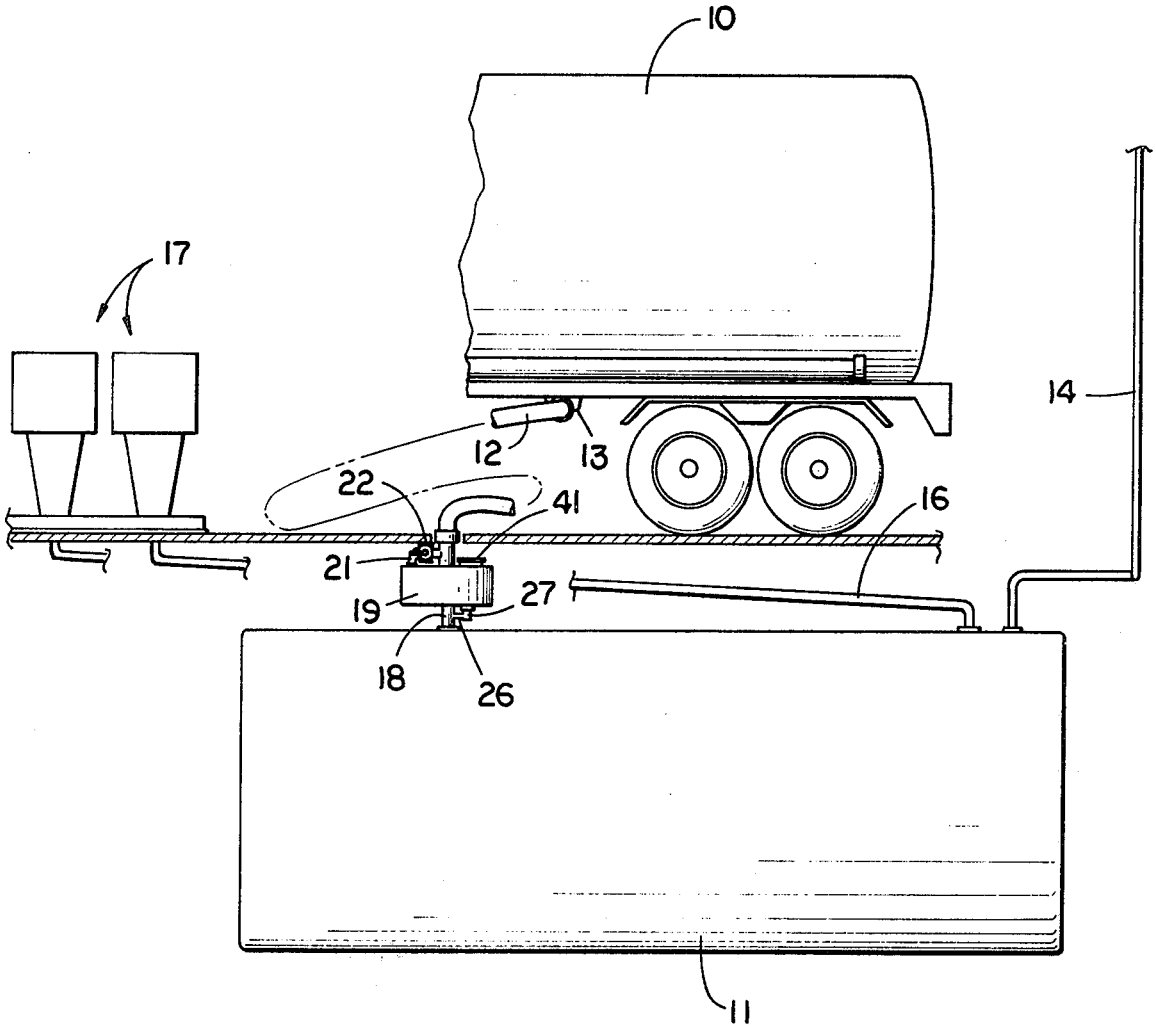
FIG. 1 is a side view of the apparatus of the present invention, installed on a typical underground gasoline service facility.

Referring initially to FIG. 1, there is shown at 10 a conventional, large, transport trailer delivering gasoline to an underground storage tank 11 by means of a flexible hose 12, flow through the hose being controlled by a valve schematically shown at 13 and located at a panel adjacent the attachment fitting for the hose. The tank 11 is provided with a venting stand pipe 14 and a delivery pipe 16 which extends to service station pumps 17 located at the station's service islands. The structure so far described will be recognized as conventional.

The apparatus of the present invention replaces the conventional fill pipe, at the tank 11, and receives the outer end of the hose 12 when the storage tank is to be filled. The apparatus includes the vertically disposed intake pipe 18 which extends centrally through a cylindrical dump tank 19, shown in detail in FIG. 2. The tank 19 has a suitable volumetric capacity, twenty-one gallons being a preferred size. The upper portion of the pipe 18 is connected, by means of a pipe or conduit 21, to the interior of tank 19 at its top wall. A manually operated, on-off valve 22 is interposed in conduit 21 and is closed during the filling of tank 11. Valve 22 is preferably a conventional butterfly-type valve such as a resilient seat, Series A valve manufactured by Center Line, Inc. of Tulsa, Oklahoma. As may be seen in FIG. 2, the valve 22 is operated by handle **22*a*** which rotates the valve stem through its 90° range of movement.

Figure 3:
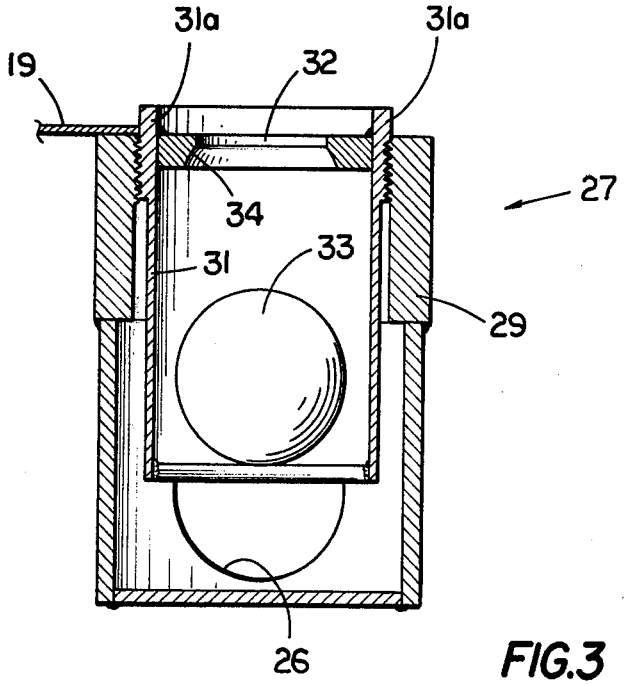
FIG. 3 is a side sectional view of the check valve component of the apparatus.

A pipe or conduit 26 extends between the base of the tank 19 and the lower portion of pipe 18. The conduit 26 has a lateral connection to a check valve assembly 27, shown in detail in FIG. 3. The valve assembly includes a tubular outer housing 29 having a closed lower end and is welded or otherwise rigidly attached to the tank 19. The pipe 26 communicates with the interior of the housing 29. Extending concentrically within the housing is an inner tubular member 31 which, at its upper end, has threaded engagement with outer housing 29. Upwardly extending lugs **31*a* on the tube 31 permit removal of the tube 31 vertically from within the tank 19**.

The tube 31 encircles an outlet aperture 32 in the base of the dump tank and flow through this aperture is controlled by cooperation of the spherical float or ball element 33 with the downwardly facing valve seat 34. A brass rod 36 extends diametrically across the tube 31 and retains the ball 33 within the tube. The assembly operates as a caged ball check valve and movement of liquid through line 26 toward the tank 19, during the filling of tank 11, is prevented by engagement of float 33 with its annular seat 34. Liquid flow from tank 19, through outlet aperture 32 to the pipe 26, is unimpeded since ball 33, under this condition, is driven off its seat 34.

Figure 2:
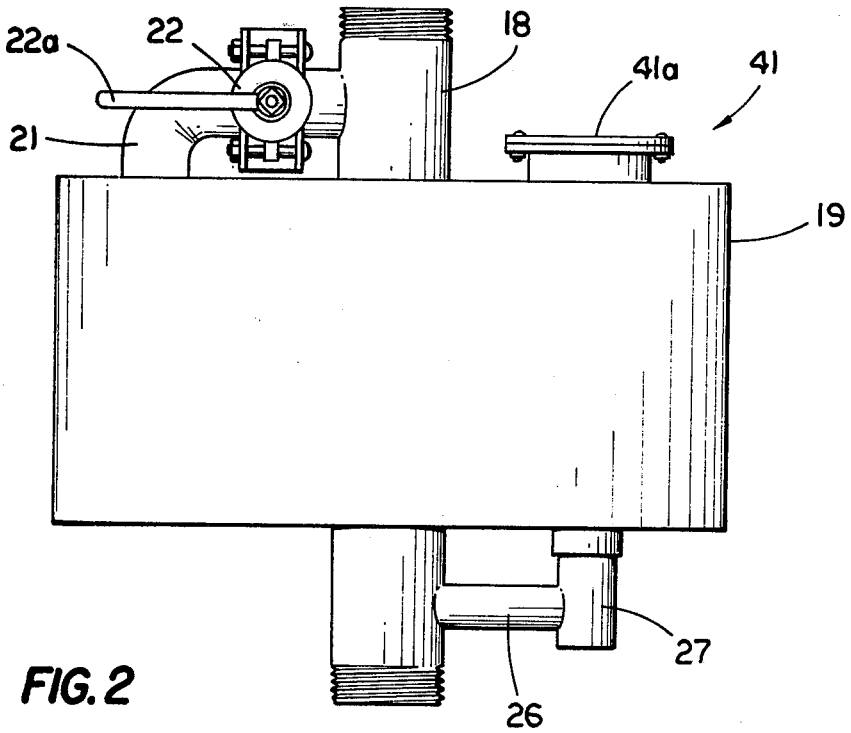
FIG. 2 is an enlarged side view of the apparatus of the present invention.

As may best be seen in FIG. 2, a sealed, but removable access hatch 41 is provided in the top wall of tank 19 and the hatch is vertically aligned with the check valve assembly 27. Upon removal of hatch cover **41*a*, a tool may be inserted which cooperates with lugs 31*a* (FIG. 3) to rotate the tube 31** permitting removal of the caged ball assembly through the access hatch for repair or replacement.

In operation, the transport tank delivery nozzle is attached to pipe 18 and filling of the storage tank proceeds. During the filling operation valve 22 remains closed and, since check valve 27 prevents upward flow, the dump tank 19 remains empty. At the end of the filling operation the tank 11, the pipe 18 (which replaces the conventional fill pipe) and the hose 12 are all full of gasoline. The operator closes valve 13 at the tank but before removing the hose 12, opens valve 22. The hose and the portion of the pipe 18 above pipe 21 thereupon drain into the dump tank 18. The gasoline in the hose and fill pipe is thus prevented from spilling into the tank backfill or the area adjacent the hose attachment. Subsequently, as gasoline is pumped from tank 11 to the service islands the liquid level in tank 11 will fall and tank 19 will automatically empty through check valve 27. Preparation of the storage tank for refilling requires only the reclosure of valve 22.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method for returning to a service station gasoline storage tank the gasoline trapped in the transport delivery tank hose and tank fill pipe after the tank, the fill pipe and the hose have been filled and the delivery tank valve has been closed, said method comprising providing a dump tank at a level above the storage tank but below the delivering tank hose attachment to the fill pipe, providing on-off valve controlled communication between the fill pipe and said dump tank, closing said on-off valve during filling of the storage tank, providing check valve controlled communication between the dump tank and the storage tank permitting flow from the dump tank to the storage tank but preventing reverse flow, and after the storage tank has been filled and the delivery tank valve has been closed then opening said on-off valve to dump the gasoline in the delivery tank hose and fill pipe into the dump tank for whence it is subsequently drained through said check valve to the storage tank as gasoline is pumped from the storage tank.

2. An anti-spill apparatus for gasoline storage tanks of the type which are filled from the flexible hose of a gasoline transport vehicle, said apparatus comprising an intake pipe adapted to replace the conventional fill pipe on the storage tank, a dump tank adjacent said intake pipe, a first conduit providing communication between the dump tank and the fill pipe and an on-off valve controlling flow through the first conduit, a second conduit connecting a drain aperture in the dump tank to said intake pipe, a check valve interposed in said second conduit permitting flow only from said dump tank to said intake pipe, whereby during filling of the storage tank and with said on-off valve closed the dump tank remains empty but accomodates the gasoline trapped in the hose of the transport vehicle when said on-off valve is opened.

3. An anti-spill apparatus as claimed in claim 2 in which said dump tank is cylindrical in configuration with said intake pipe extending centrally therethrough and vertically disposed.

4. An anti-spill apparatus as claimed in claim 3 in which said first conduit extends laterally from the intake pipe adjacent its upper end to the top of said dump tank and said second conduit extends laterally from the intake pipe adjacent its lower end to the base of said dump tank.

5. An anti-spill apparatus as claimed in claim 2 in which said on-off valve is manually operated and said check valve takes the form of a caged ball member cooperating with an adjacent valve seat.

6. An anti-spill apparatus as claimed in claim 5 in which said valve seat is located adjacent an outlet aperture in the base of the dump tank and an access hatch is provided in the top of the dump tank vertically aligned with said outlet aperture.

7. An anti-spill apparatus as claimed in claim 6 in which said caged ball and valve seat form a subassembly which is adapted to be removed from said second conduit through said access hatch.

* * * * *